US008172118B2

(12) United States Patent
Niblett et al.

(10) Patent No.: US 8,172,118 B2
(45) Date of Patent: May 8, 2012

(54) HEIGHT ADJUSTABLE COIL NAIL CANISTER

(75) Inventors: James R Niblett, Columbia, MD (US); Todd A Hagan, Windsor, PA (US); Glen V Steinbrunner, Forest Hill, MD (US); William H Harman, Westminster, MD (US)

(73) Assignee: Black & Decker Inc., Newark, DE (US)

( * ) Notice: Subject to any disclaimer, the term of this patent is extended or adjusted under 35 U.S.C. 154(b) by 1848 days.

(21) Appl. No.: 10/852,990

(22) Filed: May 25, 2004

(65) Prior Publication Data

US 2005/0263560 A1 Dec. 1, 2005

(51) Int. Cl.
*B27F 7/02* (2006.01)

(52) U.S. Cl. ..... 227/120; 227/8; 227/135

(58) Field of Classification Search ..... 227/8, 120, 227/135, 136, 142
See application file for complete search history.

(56) References Cited

U.S. PATENT DOCUMENTS

| | | | | |
|---|---|---|---|---|
| 3,330,462 | A | | 7/1967 | Colechia et al. |
| 3,524,576 | A | | 8/1970 | Bader |
| 3,568,908 | A | | 3/1971 | Bader |
| 3,945,551 | A | | 3/1976 | Sato et al. |
| 4,433,782 | A | | 2/1984 | Figge et al. |
| 4,518,109 | A | | 5/1985 | Shiroyama |
| 4,585,154 | A | | 4/1986 | Fealey et al. |
| 4,600,135 | A | | 7/1986 | Mukoyama |
| 4,669,648 | A | | 6/1987 | Monacelli |
| 5,297,713 | A | * | 3/1994 | Perra et al. ..... 227/123 |
| 5,634,582 | A | | 6/1997 | Morrison, Jr. et al. |
| 5,683,024 | A | | 11/1997 | Eminger et al. |
| 5,697,541 | A | | 12/1997 | Burke et al. |
| 5,897,046 | A | * | 4/1999 | Oehri et al. ..... 227/119 |
| 6,152,346 | A | | 11/2000 | Laubach |

FOREIGN PATENT DOCUMENTS

| | | |
|---|---|---|
| DE | 2462377 | 5/1984 |
| JP | 09117875 | 9/1997 |
| JP | 2000 108049 | 9/2000 |

OTHER PUBLICATIONS

Parts Reference Guide (SCN40R), Senco Products, Inc., Cincinnati, OH 45244.

* cited by examiner

*Primary Examiner* — Rinaldi Rada
*Assistant Examiner* — Nathaniel Chukwurah
(74) *Attorney, Agent, or Firm* — Harness, Dickey & Pierce, P.L.C.

(57) ABSTRACT

A fastening tool with a magazine housing, a nail plate in the magazine housing and an actuator disposed between the nail plate and the magazine housing. The actuator extends outwardly from the nail plate so as to be movable by a user to cause the nail plate to move axially with respect to the magazine housing.

25 Claims, 16 Drawing Sheets

HEIGHT ADJUSTABLE COIL NAIL CANISTER

INTRODUCTION

The present invention generally relates fastening tools having a canister for storing fasteners that are dispensed as the fastening tool is operated and more particularly to a canister for storing fasteners that may be readily adjusted when changing between fasteners of different lengths.

SUMMARY

In one form, the present teachings provide a fastening tool that includes a magazine housing, a nail plate in the magazine housing and an actuator that is disposed between the nail plate and the magazine housing. The actuator extends outwardly from the nail plate so as to be movable by a user to cause the nail plate to move axially with respect to the magazine housing.

In another form, the present teachings provide a fastening tool that includes a magazine housing having a housing top, a nail plate disposed in the magazine housing, and a nail plate adjuster for axially adjusting a position of the nail plate relative to the housing top. The nail plate adjuster is user-adjustable from the exterior of the magazine housing.

In yet another form, the present teachings provide a fastening tool that includes a tool housing and a magazine assembly which is coupled to the tool housing and has a magazine housing, a nail plate, a rotary cam and a spring. The magazine housing includes a first portion, which has a central post, and a second portion that is hingedly coupled to the first portion. The nail plate is disposed over the central post and is axially but non-rotatably movable thereon. The rotary cam is disposed about the central post between the nail plate and a bottom member of the first portion of the magazine housing. The rotary cam includes an adjustment lever that extends outwardly of the first portion of the magazine housing. The spring biases the nail plate toward the rotary cam such that a plurality of feet that are coupled to the nail plate contact the rotary cam. Rotation of the rotary cam about the central post effects a change in a position of the nail plate relative to the central post.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE VARIOUS EMBODIMENTS

Figure 1:
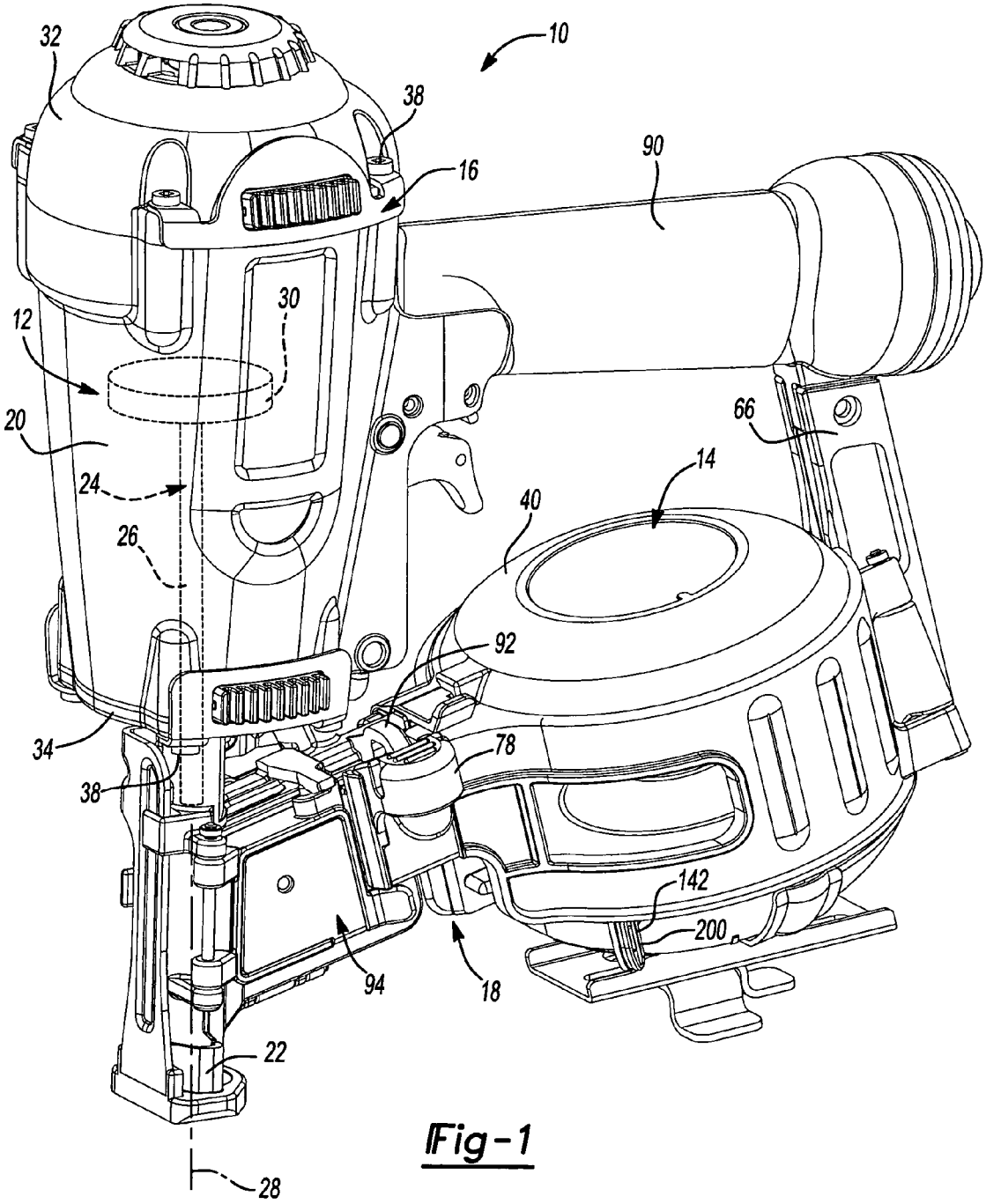
FIG. 1 is a perspective view of a fastening tool constructed in accordance with the teachings of the present invention.

With reference to FIG. 1 of the drawings, a fastening tool constructed in accordance with the teachings of the present invention is generally indicated by reference numeral 10. The fastening tool 10 may include a housing assembly 12 and a magazine assembly 14. The housing assembly 12 may include a housing 20, which may be formed from any appropriate material including aluminum, magnesium and/or plastic, and a nosepiece 22. The housing 20 conventionally houses a motor 24 with a driver 26 that may be selectively translated along an axis 28 to drive a fastener into a workpiece (not shown). In the particular example provided, the housing 20 includes a central portion 30 and an upper end cap 32, which is configured to close off an upper end of the central portion 30, while the nosepiece 22 includes an upper flange 34 that is configured to close off a lower end of the central portion 30. Conventional fasteners 38, such as socket head cap screws, may be employed to fixedly but removably couple the upper end cap 32 and nosepiece 22 to the central portion 30. While not specifically shown, those of ordinary skill in the art will appreciate that conventional gaskets or seals may be employed to seal the interfaces between the upper end cap 32 and the central portion 30 and between the central portion 30 and the nosepiece 22.

Figure 2:
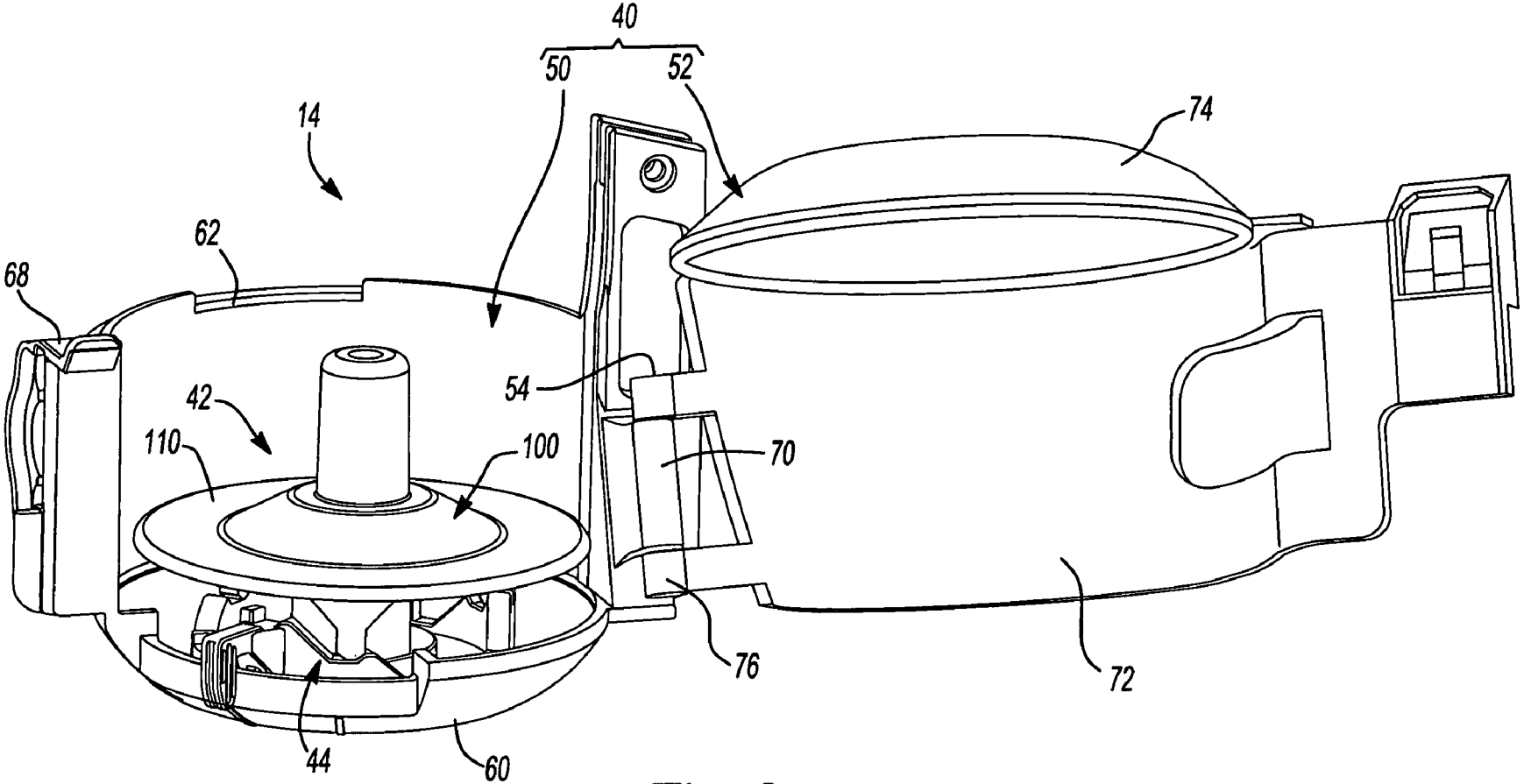
FIG. 2 is a perspective view of a portion of the fastening tool of FIG. 1 illustrating the magazine housing in an open condition.
Figure 3:
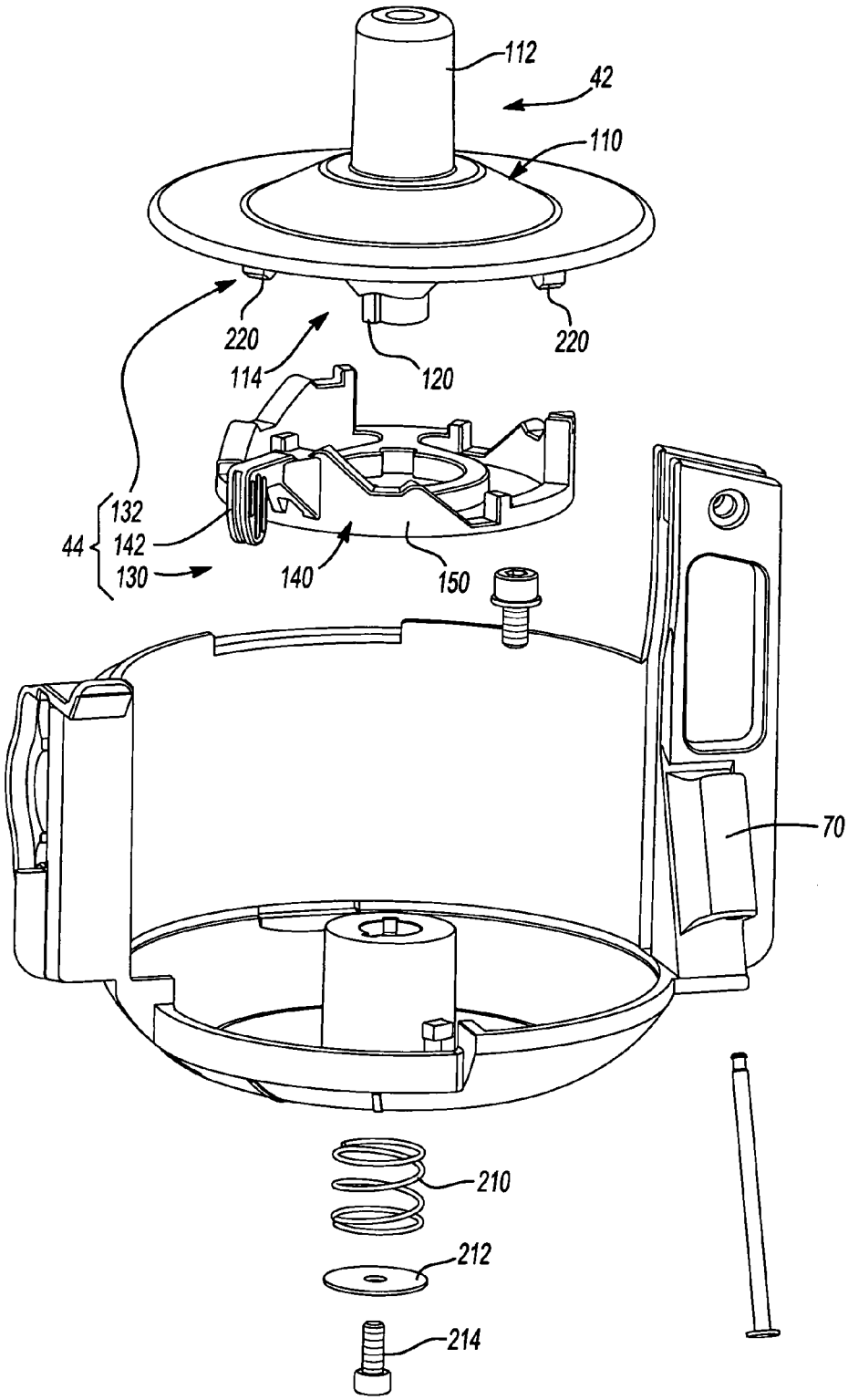
FIG. 3 is an exploded, partially broken away perspective view of a portion of the fastening tool of FIG. 1 illustrating the magazine assembly in greater detail.

With additional reference to FIGS. 2 and 3, the magazine assembly 14, which may be coupled to the housing assembly 12, is configured to house a plurality of fasteners and sequentially feed the fasteners into the nosepiece 22. In the particular example provided, the magazine assembly 14 may include a magazine housing 40 for holding coiled, collated nails, a nail plate 42, and a nail plate height adjuster 44.

The magazine housing 40 may include a first housing portion 50, a second housing portion 52 and a hinge pin 54. The first housing portion 50 may include a housing bottom 60, a first sidewall 62, a central post 64, first and second magazine mounts 66 and 68, respectively, and a first hinge mount 70, while the second housing portion 52 may include a second sidewall 72, a housing top 74, a second hinge mount 76 and a latch 78.

The first sidewall 62 may be coupled to the housing bottom 60 so as to wrap around a portion of the perimeter of the housing bottom 60. The central post 64 may extend upwardly from the housing bottom and may be a generally cylindrically hollow structure having one or more radially extending tabs 80 that extend therefrom. A receiving aperture 82 may be formed through an upper flange 84 of the central post 64 and may have one or more keying features, such as a pair of tab slots 88. The first and second magazine mounts 66 and 68 are configured to facilitate the mounting of the magazine housing 40 to the fastening tool 10 at convenient points. In the particular example provided, the first magazine mount 66 is configured to permit the magazine housing 40 to be coupled to the handle 90 of the fastening tool 10 at a first point, while the second magazine mount 68 is configured to permit the magazine housing 40 to be coupled to the exhaust outlet 92 of a feed mechanism 94 that feeds fasteners from the magazine housing 40 into the nosepiece 22.

The second sidewall 72 may be coupled to the housing top 74 so as to wrap around a portion of the perimeter of the housing top 74. The hinge pin 54 cooperates with the first and second hinge mounts 70 and 76 to pivotally mount the second housing portion 52 on the first housing portion 50 so that the second housing portion 52 may be moved between a closed position and an open position which permits access to the interior 100 of the magazine housing 40.

The nail plate 42 may include a plate-like structure 110, a central upper hub 112, which is configured to extend through and support a coil of the collated fasteners, and a central lower hub 114, which is received into the receiving aperture 82 of the central post 64. In the particular example provided, the central lower hub 114 includes a pair of tab members 120 that are configured to be received into the tab slots 88. The tab members 120 and the tab slots 88 may cooperate so that the plate-like structure 110 of the nail plate 42 may be axially but non-rotatably moveable relative to the magazine housing 40. In the embodiment illustrated, the central lower hub 114 is slidingly received into the central post 64 and the tab members 120 and the tab slots 88 cooperate to both inhibit relative rotation therebetween and to "key" or align the nail plate 42 to the magazine housing 40 in a predetermined orientation.

Figure 3A:
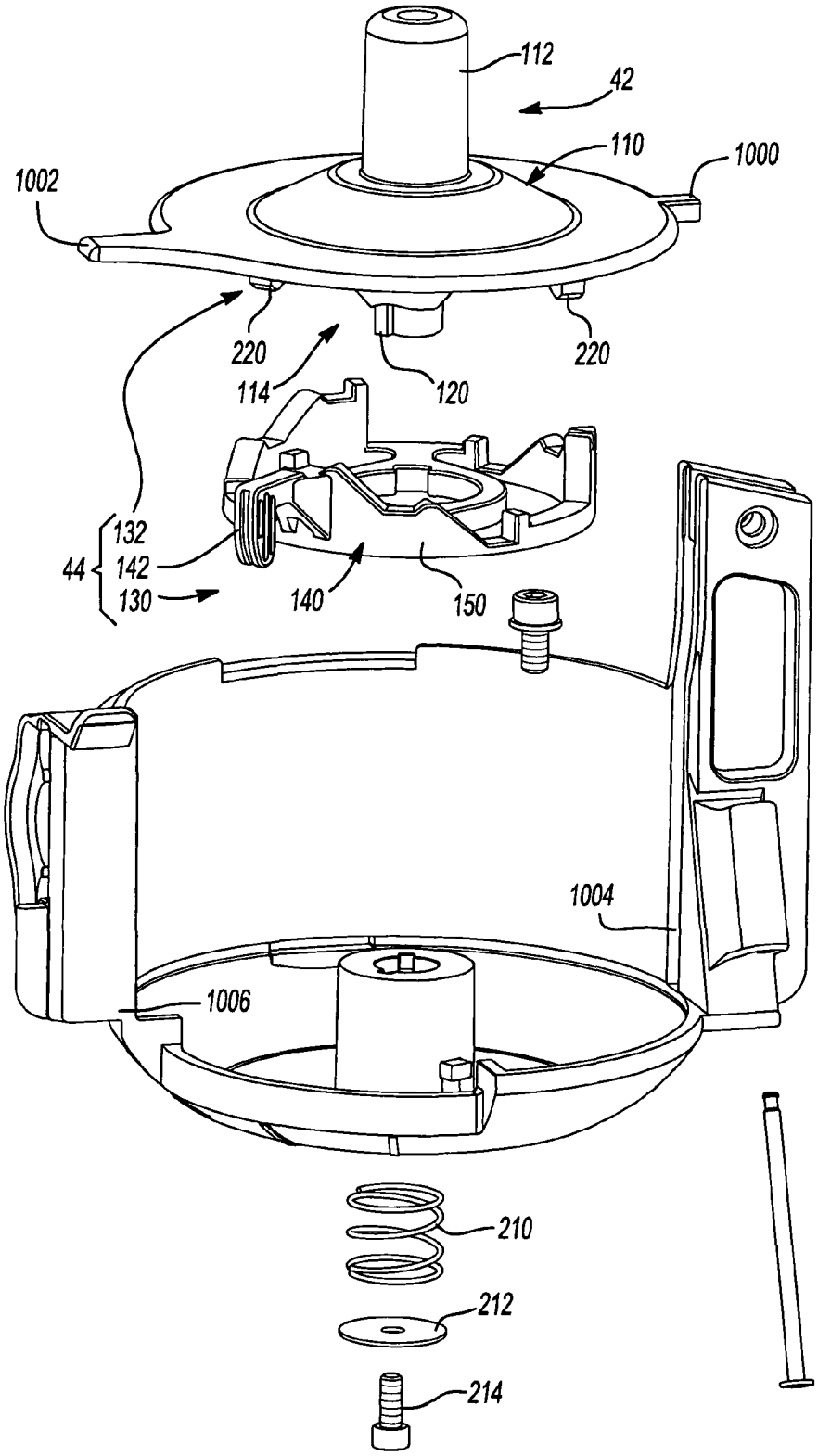
FIG. 3A is a view that is similar to that of FIG. 3 but illustrating an alternately constructed nail plate.
Figure 4:
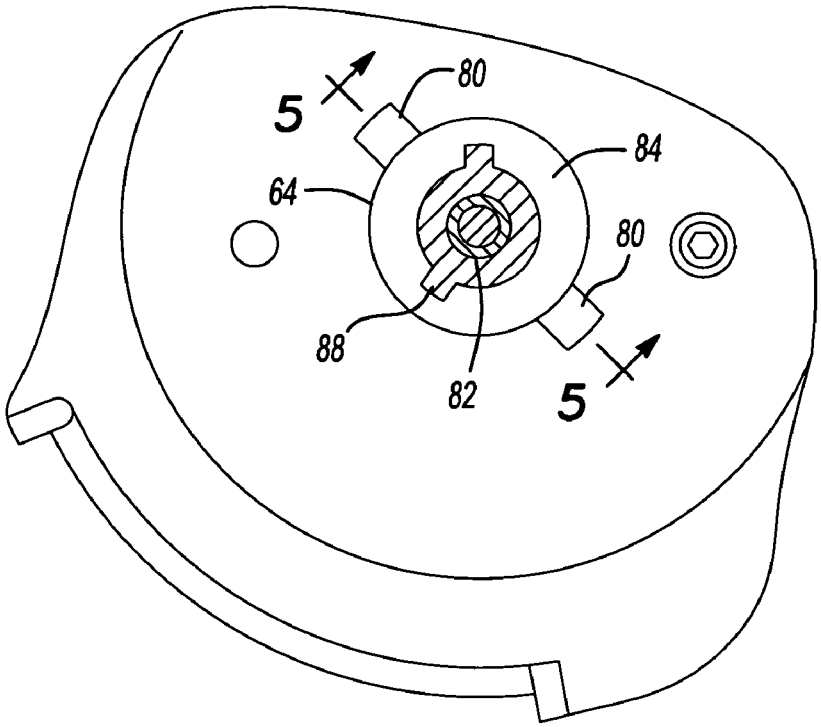
FIG. 4 is a top view of a portion of the magazine housing.
Figure 5:
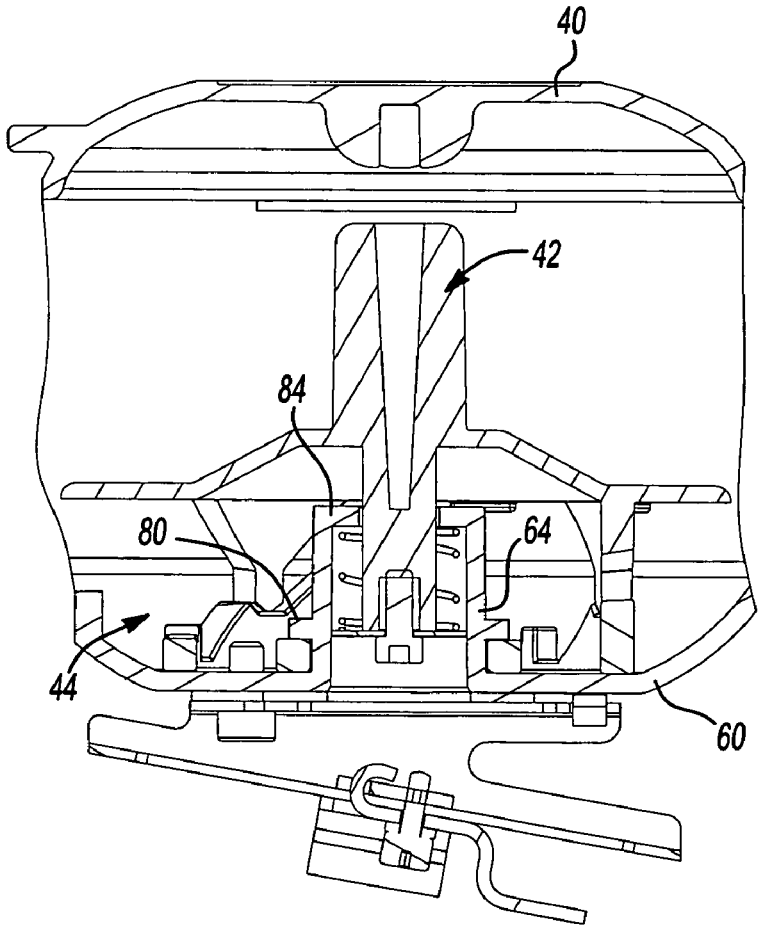
FIG. 5 is a longitudinal sectional view of the magazine assembly.
Figure 6:
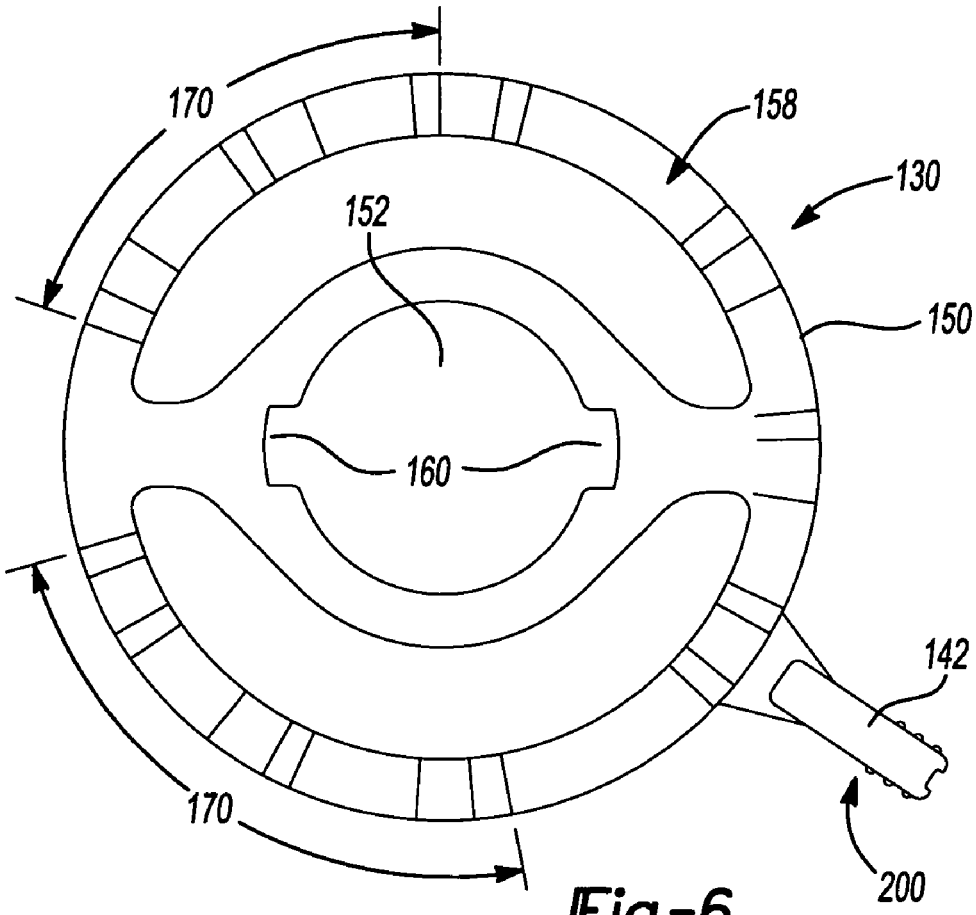
FIG. 6 is a top plan view of a portion of the magazine assembly illustrating the cam in greater detail.
Figure 7:
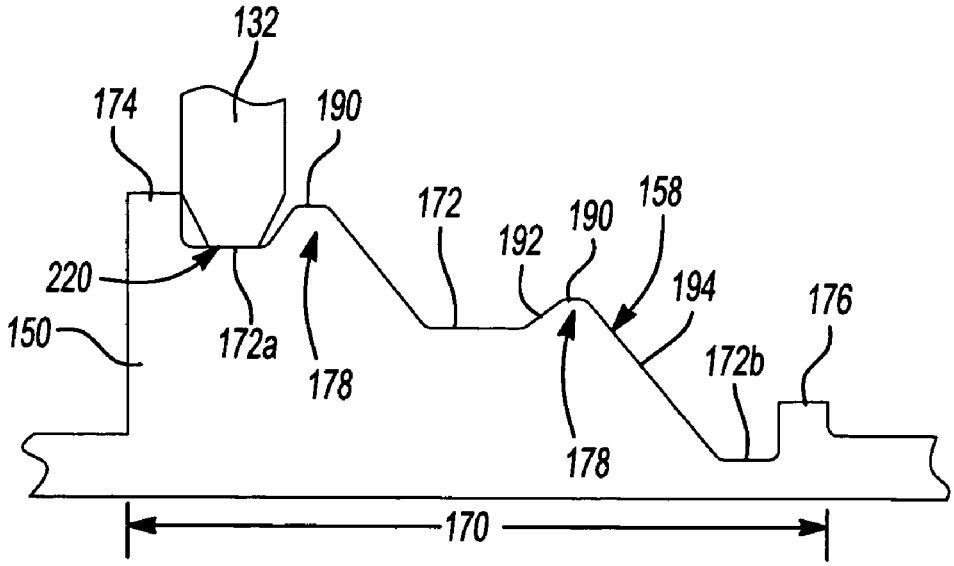
FIG. 7 is a schematic illustration of the cam profile in an "unwrapped" state.
Figure 8:
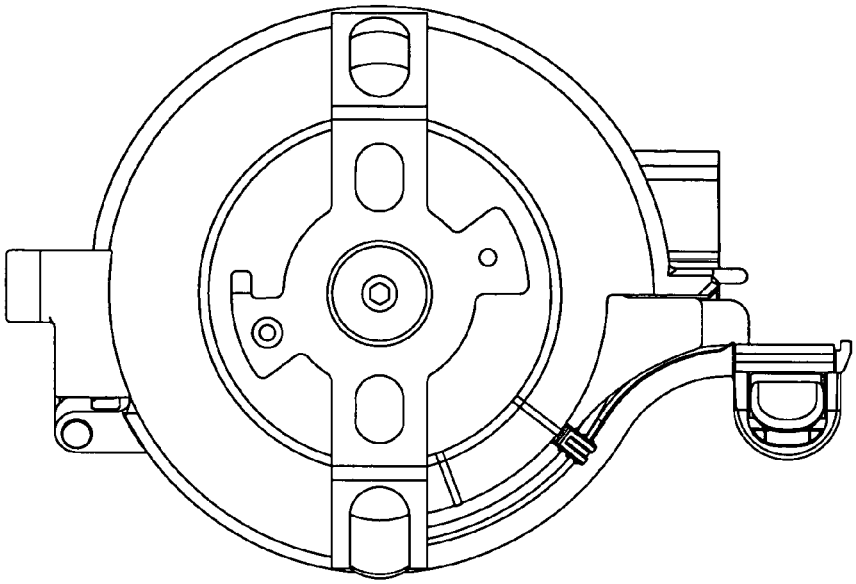
FIG. 8 is a bottom view of the magazine assembly.
Figure 9:
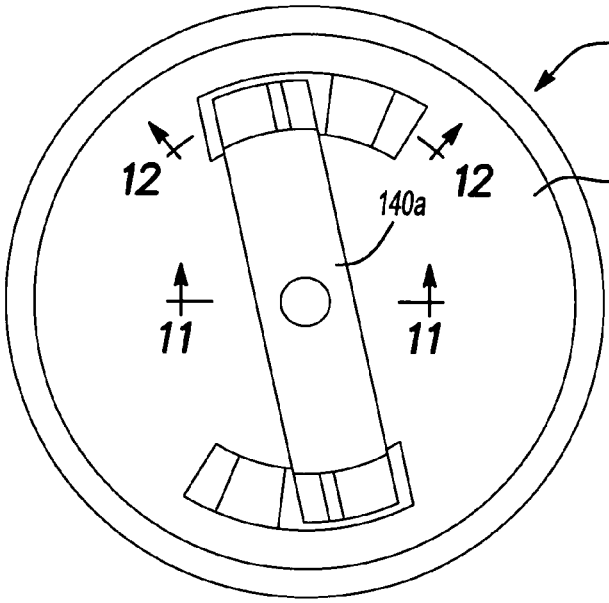
FIG. 9 is a top plan view of a portion of a second magazine assembly constructed in accordance with the teachings of the present invention.
Figure 10:
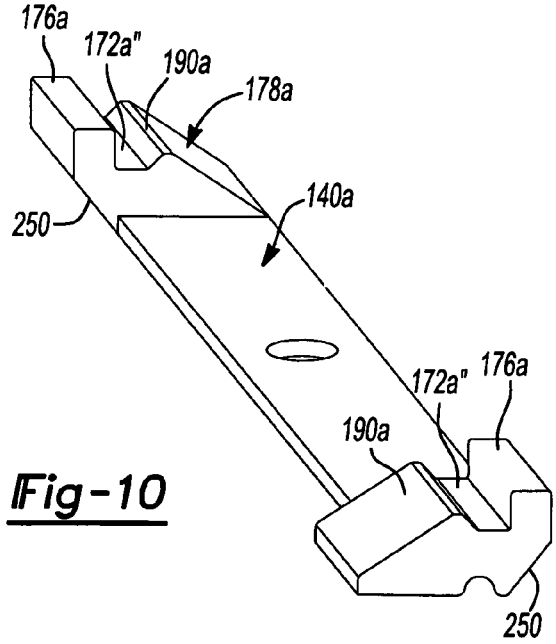
FIG. 10 is a perspective view of a portion of the magazine assembly of FIG. 9 illustrating the cam in greater detail.
Figure 11:
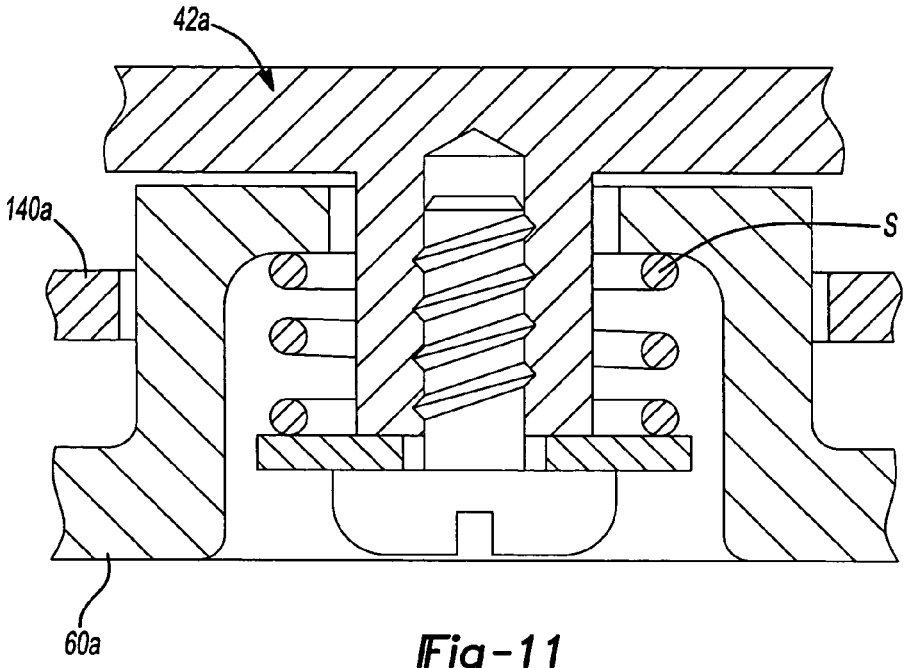
FIG. 11 is a sectional view taken along the line 11-11 of FIG. 9.
Figure 12:
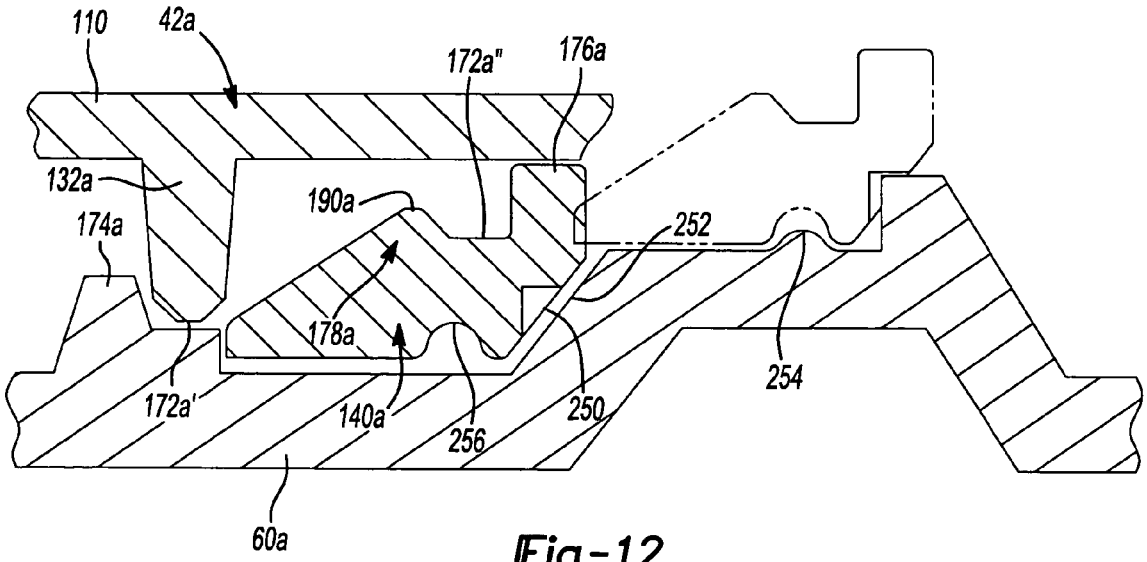
FIG. 12 is a sectional view taken along the line 12-12 of FIG. 9.

With brief reference to FIG. 3A, the plate-like structure 110 of the nail plate 42 may alternatively or additionally include a plurality of tabs 1000 and 1002 that are configured to engage the magazine housing 40 to resist the rotation of the nail plate 42 relative to the magazine housing 40. The tabs 1000 and 1002 may be configured to engage corresponding recesses that are formed in or features that are formed on the magazine housing 40. For example, the tab 1000 may be slidably received in a channel 1004 that is formed by the first and second housing portions, while the tab 1002 may be abutted against a vertical wall 1006 that is formed on the first housing portion on one side and the second housing portion on an opposite side (when the second housing portion is positioned in the closed position).

The nail plate height adjuster 44 may include an actuator 130 and a plurality of legs 132, which may be coupled to and extend downwardly from the plate-like structure 110 of the nail plate 42. The actuator 130 may include a cam 140 and a lever 142. The cam 140 may include a cam body 150 having a central aperture 152, which is sized to receive the central post 64, and a cam profile 158.

The central aperture 152 may include a quantity of tab recesses 160 that are configured to permit the cam 140 to slide over the radially extending tabs 80 (that are coupled to the central post 64) when the cam 140 is oriented in a predetermined position. Rotation of the cam 140 out of the predetermined position when the cam 140 has been slid over the radially extending tabs 80 and abutted against the housing bottom 60 permits the radially extending tabs 80 to limit upward axial movement of the cam 140 along the central post 64.

The cam profile 158 may include a plurality of identically-configured profile segments 170 that cooperate with the legs 132 to axially position the nail plate 42 relative to the magazine housing 40. Each profile segment 170 may include a plurality of adjustment lands 172, a pair of end abutments 174 and 176, and an intermediate ramp 178 between each adjacent pair of adjustment lands 172. Each adjustment land 172 may be located at a vertically different position relative to the remaining adjustment lands 172. In the example provided, each of the adjustment lands 172 differs in height by about ¼" (6.35 mm). The end abutments 174 and 176 may be disposed on opposite sides of the profile segment 170 and border the first or highest adjustment land 172*a* and the last or lowest adjustment land 172*b*, respectively. Each intermediate ramp 178 may include a point 190, which may be located proximate a higher one of the adjacent adjustment lands 172, a first ramp section 192, which may extend between the higher one of the adjacent adjustment lands 172 and the point 190, and a second ramp section 194, which may extend between the lower one of the adjacent adjustment lands 172 and the point 190.

The lever 142 may extend outwardly from the cam body 150 and may be shaped in any desired manner. In the particular example provided, the lever 142 is generally L-shaped and defines a finger or thumb tab 200 which may be used by the operator of the fastening tool 10 to rotate the cam 140 about the central post 64.

With the cam 140 located about the central post 64 and the central lower hub 114 disposed in the receiving aperture 82, a compression spring 210 may be fitted about the central lower hub 114. A washer 212 and a threaded fastener 214, which may be threadably coupled to the central lower hub 114, may be employed to capture the spring 210 between the upper flange 84 and the lower end of the central lower hub 114. The spring 210 may operably bias the nail plate 42 downwardly toward the housing bottom 60 to thereby maintain a lower contact surface 220 of the legs 132 in contact with the cam profile 158. As best shown in FIGS. 2 through 5, an input may be provided to the lever 142 that causes the cam 140 to rotate about the central post 64; the legs 132 follow the cam profile 158 along an associated profile segment 170 as the cam 140 is rotated to thereby axially move the nail plate 42 relative to the magazine housing 40. Alignment of an adjustment land 172 to the leg 132 positions the leg 132 between an intermediate ramp 178 and either an end abutment 174 or 176, or another intermediate ramp 178, which tends to maintain the cam 140 in a stationary position relative to the magazine housing 40 so that the plate-like structure 110 of the nail plate 42 may be maintained in a predetermined position relative to the magazine housing 40. Contact between the end abutments 174 and 176 and an associated one of the legs 132 limits the amount by which the cam 140 may be rotated. The lower contact surface 220 of the legs 132 may be chamfered or rounded.

While the nail plate height adjuster has been illustrated in the attached figures and described above as including a cam and a plurality of legs, those of ordinary skill in the art will appreciate from this disclosure that the invention, in its broader aspects, may be constructed somewhat differently. In this regard, the magazine assembly may be constructed as shown in FIGS. 9 through 12. In this example, the cam 140*a* and the nail plate 42*a* may be rotated to effect a change in the axial location of the plate-like structure 110 of the nail plate 42*a*. A spring S is configured to bias the nail plate 42*a* toward the housing bottom 60*a*. In a first or lowest setting, a leg 132*a* that is coupled to the nail plate 42*a* contacts an adjustment land 172*a*' that is formed on the housing bottom 60*a*. An end abutment 174*a* inhibits rotation of the nail plate 42*a* in a direction opposite the cam 140*a*.

In a second or intermediate setting, the leg 132*a* is positioned on an adjustment land 172*a*" that is formed on the cam 140*a*. An intermediate ramp 178*a* may be formed on the cam 140*a* and may be similar to the intermediate ramp discussed above in that it may include a point, a first portion, which may be located proximate the higher one of the adjustment lands and taper between the point and the higher one of the adjacent adjustment lands, and a second portion, which tapers between the point and the lower one of the adjustment lands. An end abutment 176*a* cooperates with the point 190*a* to trap the leg 132*a* on the adjustment land 172*a*" when the leg 132*a* has been positioned thereon.

In a third or highest setting, both the cam 140*a* and the nail plate 42*a* may be rotated. The cam 140*a* may include a tapered abutting surface 250 that rides over a mating abutting surface 252 that may be formed on the housing bottom 60*a*. A detent 254 that may be formed on the housing bottom 60*a* may engage a mating feature 256 that is formed on the cam 140*a*; engagement of the detent 254 and mating feature 256 inhibits rotation of the cam 140*a* relative to the housing bottom 60*a*.

From the foregoing, those of ordinary skill in the art will appreciate that by rotating both the cam 140*a* and the nail plate 42*a*, a height savings may be realized which renders the magazine assembly 14*a* somewhat more compact as compared with the embodiment of FIGS. 1 through 8.

Figure 13:
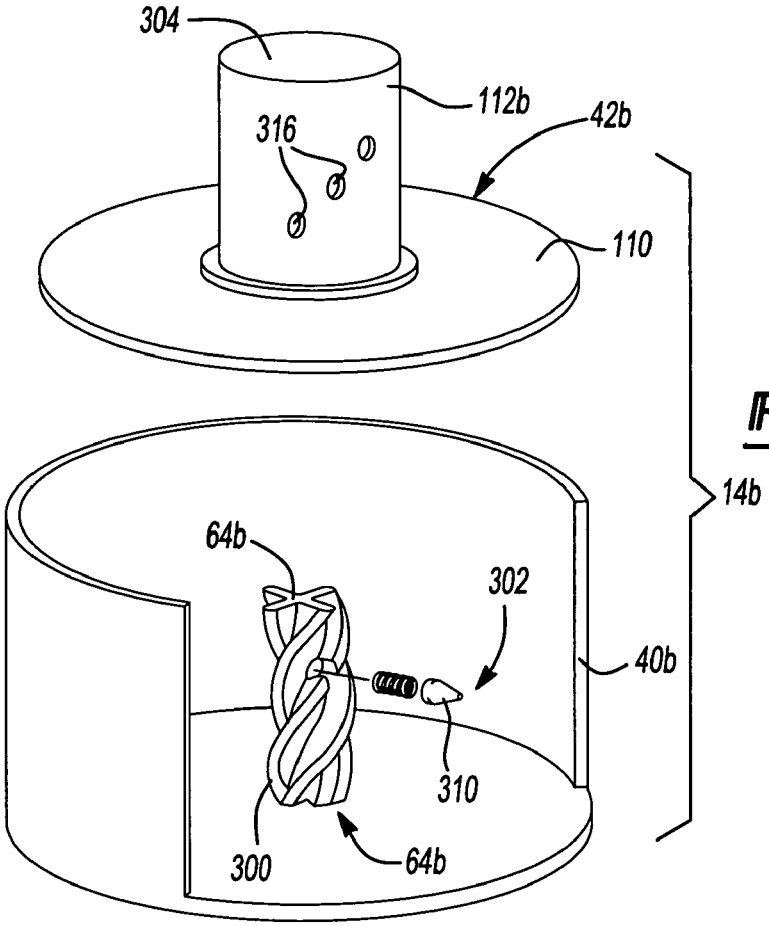
FIG. 13 is an exploded perspective view of a third magazine assembly constructed in accordance with the teachings of the present invention.
Figure 14:
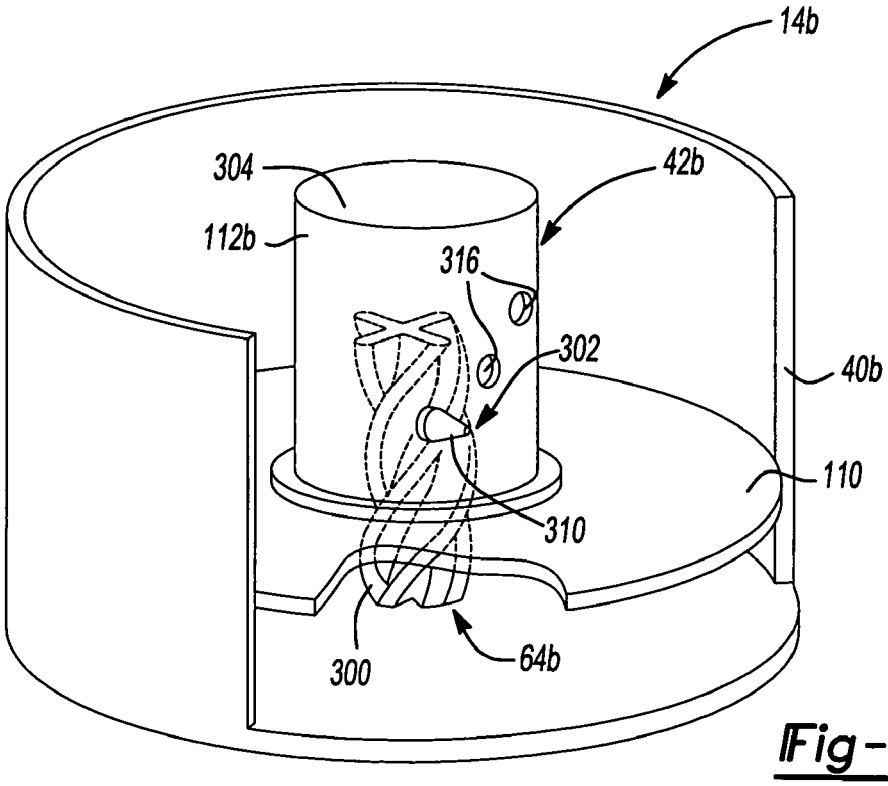
FIG. 14 is a perspective view of the magazine assembly of FIG. 13.
Figure 15:
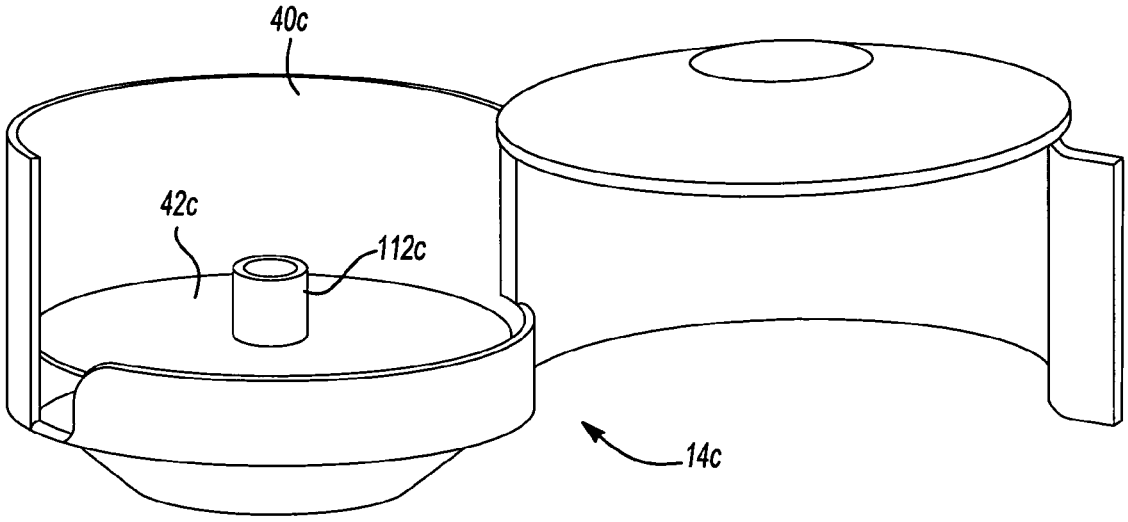
FIG. 15 is a perspective view of a fourth magazine assembly constructed in accordance with the teachings of the present invention
Figure 16:
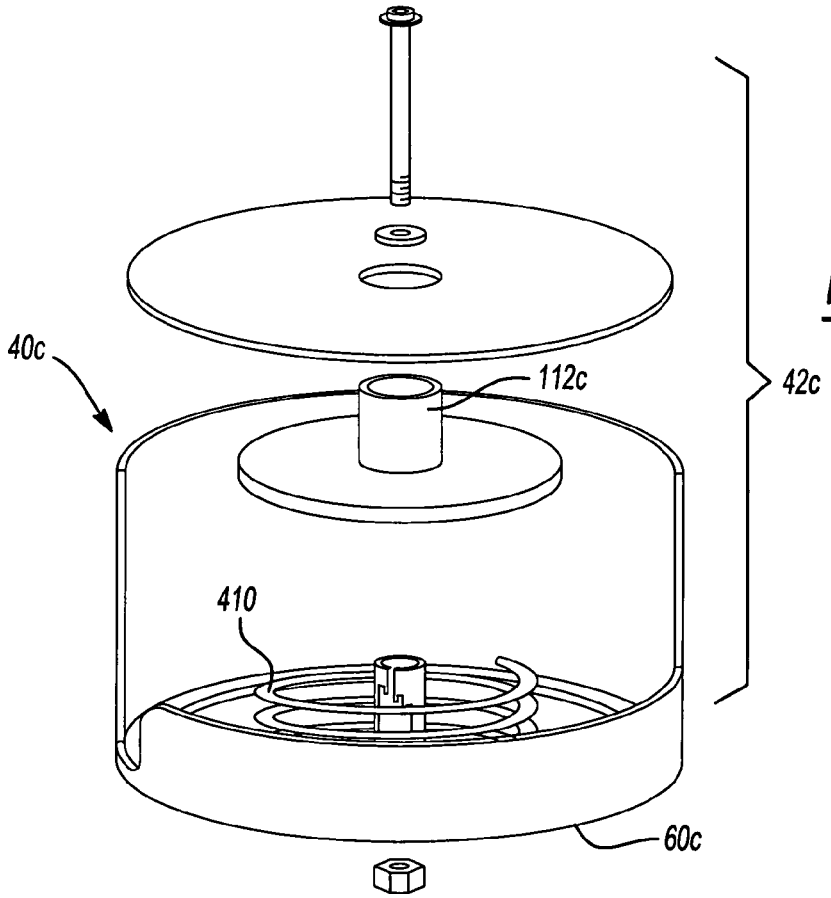
FIG. 16 is an exploded perspective view of the magazine assembly of FIG. 15.
Figure 17:
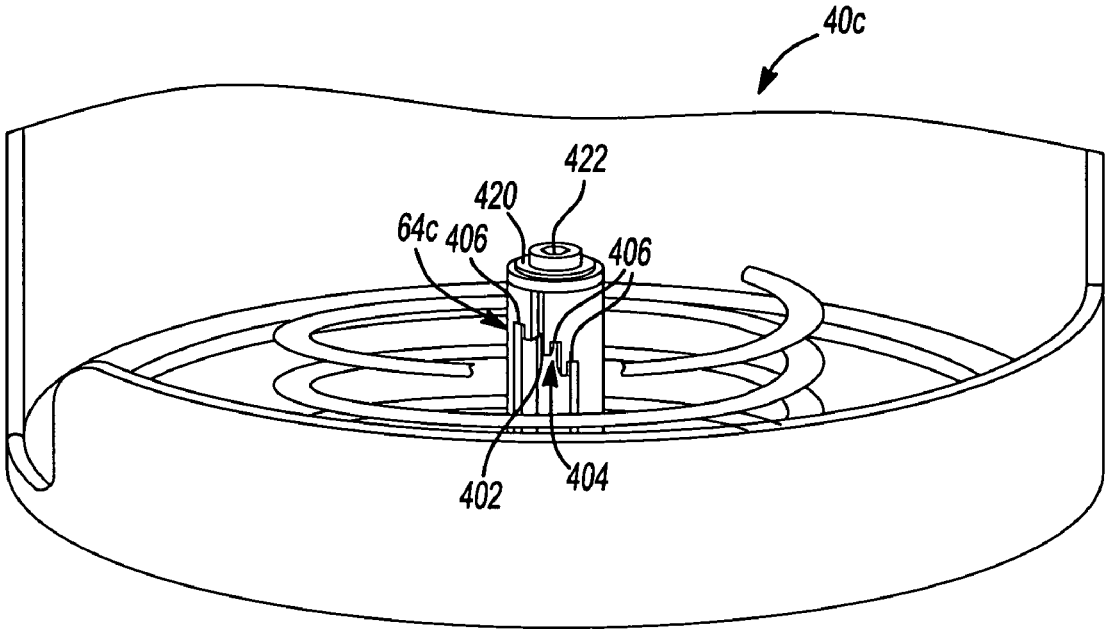
FIG. 17 is a perspective view of a portion of the magazine assembly of FIG. 15 illustrating the magazine housing in greater detail.
Figure 18:
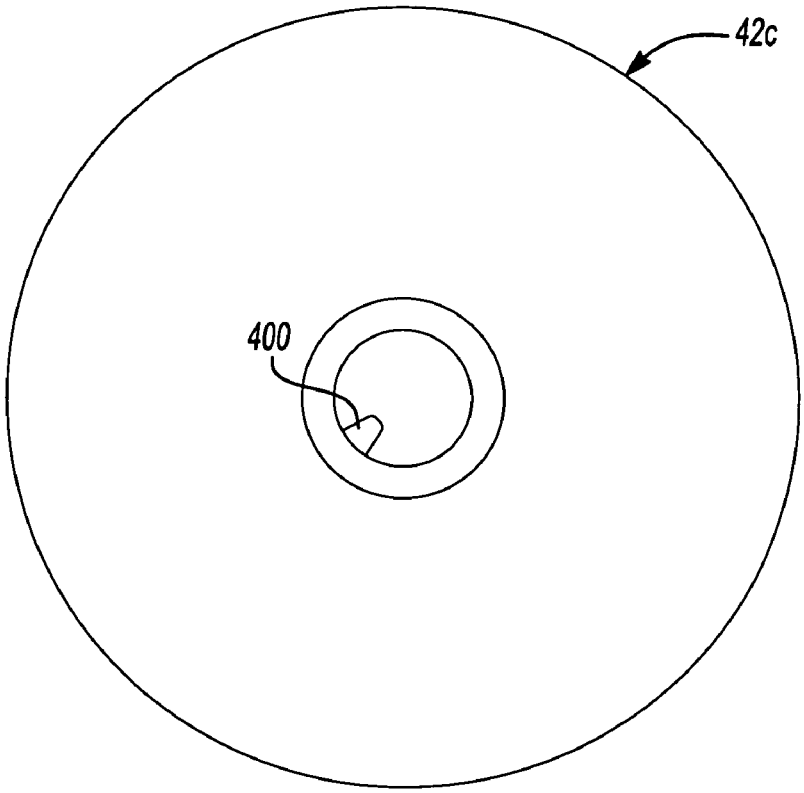
FIG. 18 is a top plan view of a portion of the magazine assembly of FIG. 15 illustrating the nail plate in greater detail.

A third magazine assembly 14*b* constructed in accordance with the teachings of the present invention is illustrated in FIGS. 13 and 14. The magazine assembly 14*b* may include a magazine housing 40*b*, and a nail plate 42*b*. The magazine housing 40*b* is generally similar to the magazine housing 40 of FIG. 3, except for the configuration of the central post 64*b*. The central post 64*b* may include at least one helical form 300 and a detent device 302. The helical form 300 may be sized to matingly engage a hollow bore 304 that is formed in the central upper hub 112*b* of the nail plate 42*b*. The detent device 302 includes a pin or plunger 310 that is biased outwardly of the central post 64*b*.

The central upper hub 112*b* of the nail plate 42*b* meshingly engages the central post 64*b* and includes a plurality of positioning apertures 316 that are configured to receive the plunger 310 of the detent device 302. More specifically, rotation of the nail plate 42*b* on the central post 64*b* permits the plate-like structure 110 of the nail plate 42*b* to be moved axially along the central post 64*b*. As the plunger 310 is biased outwardly of the central post 64*b*, alignment of the plunger 310 with one of the positioning aperture 316 permits the plunger 310 to travel outwardly and into the positioning aperture 316. Engagement of the plunger 310 to the central upper hub 112*b* inhibits further rotation of the nail plate 42*b* so that the plate-like structure 110 is maintained in at a predetermined elevation. To change the elevation of the plate-like structure 110, the plunger 310 may be pushed into a retracted condition. Additionally or alternatively, the plunger 310 and the central upper hub 112*b* may be configured such that the plunger 310 automatically retracts when a torque that exceeds a predetermined torque is applied to the nail plate 42*b*.

A fourth magazine assembly 14*c* constructed in accordance with the teachings of the present invention is illustrated in FIGS. 15 through 18. In this example, the central upper hub 112*c* of the nail plate 42*c* may include a locking tab 400, while the central post 64*c* of the magazine housing 40*c* may include a lock tab slot 402 and a plurality of inverted L-shaped lock tab recesses 404 that terminate at a flange 406. Each of the flanges 406 are positioned at different elevations. Alignment of the locking tab 400 with the lock tab slot 402 permits the nail plate 42*c* to be translated relative to the magazine housing 40*c* along the central post 64*c*. The nail plate 42*c* may be rotated, however, to position the locking tab 400 vertically in line with one of the flanges 406. A spring 410 may urge the nail plate 42*c* away from the housing bottom 60*c* and drive the locking tab 400 into abutment with one of the flanges 406. The shape of the lock tab recess 404 inhibits or limits the rotation of the nail plate 42*c* relative to the magazine housing 40*c* so that the locking tab 400 cannot be positioned in the lock tab slot 402 without first pushing the nail plate 42*c* toward the housing bottom 60*c* to disengage the locking tab 400 from the lock tab recess 404. A washer 420, which may be secured to the central post 64*c* by a threaded fastener 422, may be employed to close the lock tab slot 402 to thereby inhibit the spring 410 from urging the nail plate 42*c* off the central post 64*c*.

Figure 19:
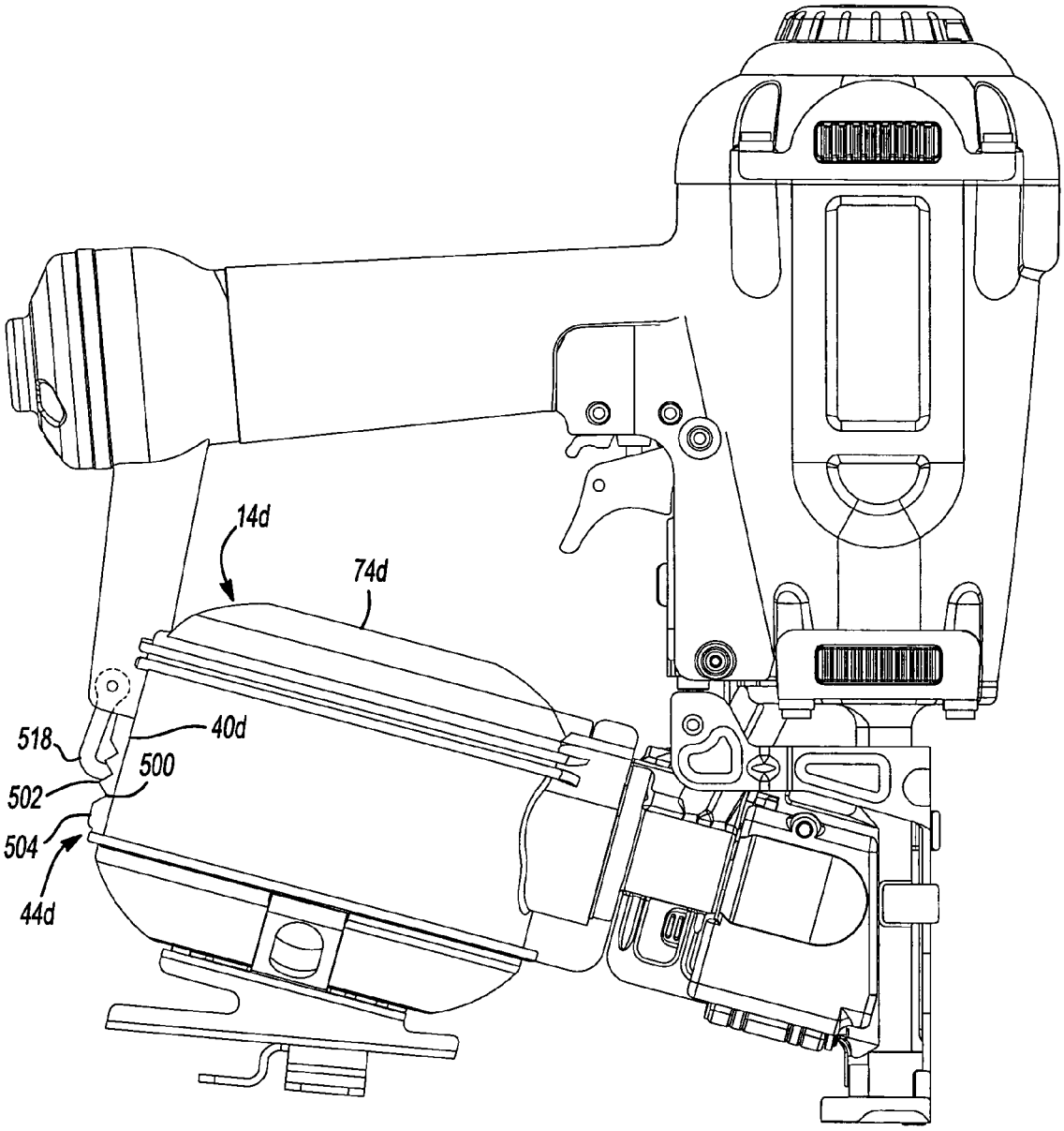
FIG. 19 is a side elevation view of a fastening tool with a fifth magazine assembly constructed in accordance with the teachings of the present invention.
Figure 20:
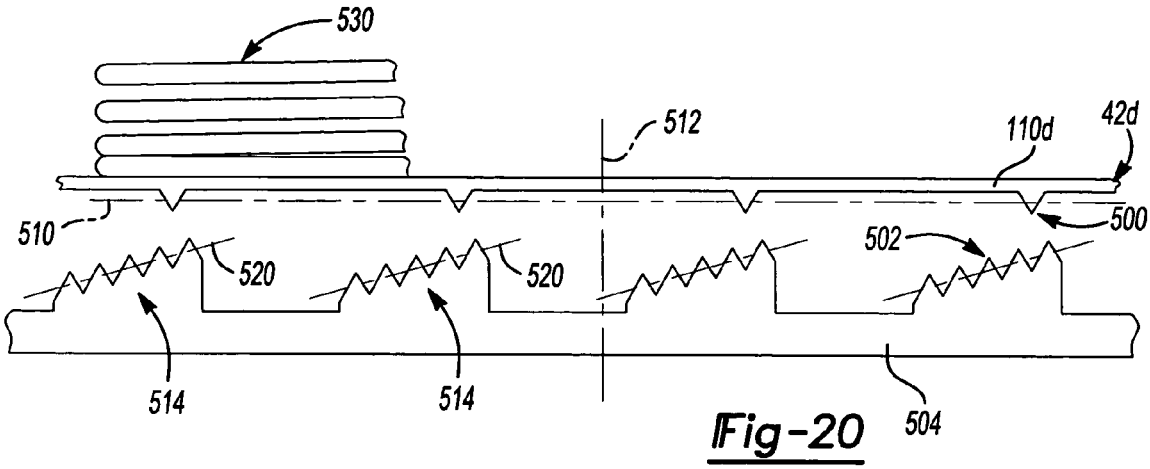
FIG. 20 is a schematic illustration illustrating the first and second sets of teeth in an "unwrapped" condition.

A fifth magazine assembly 14*d* constructed in accordance with the teachings of the present invention is illustrated in FIGS. 19 and 20. In this example, the nail plate height adjuster 44*d* may include a first set of teeth 500, which may be coupled to the plate-like structure 110*d* of the nail plate 42*d*, a second set of teeth 502, which may be coupled to a structure 504 that closes the bottom of the magazine housing 40*d*, and a latch 518 for latching the structure 504 in a closed position such that the first and second sets of teeth 500 and 502 engage one another.

The first set of teeth 500 may be arranged about a first pitch circle 510 that is generally perpendicular to an axis 512 along which the nail plate 42*d* translates. The second set of teeth 502 may be divided into a quantity of tooth groups 514 that is equal in number to the quantity of teeth in the first set of teeth 500. Each tooth group 514 includes a plurality of teeth that are arranged about a second pitch circle 520 that is tilted to the first pitch circle 510. Adjustment of the elevation of the nail plate 42d relative to the housing top 74*d* may be effected by unlatching the latch 518, rotating the second set of teeth 502 relative to the first set of teeth 500, and re-latching the latch 518. A spring 530 may be employed to bias the nail plate 42*d* away from the housing top 74*d*.

Figure 21:
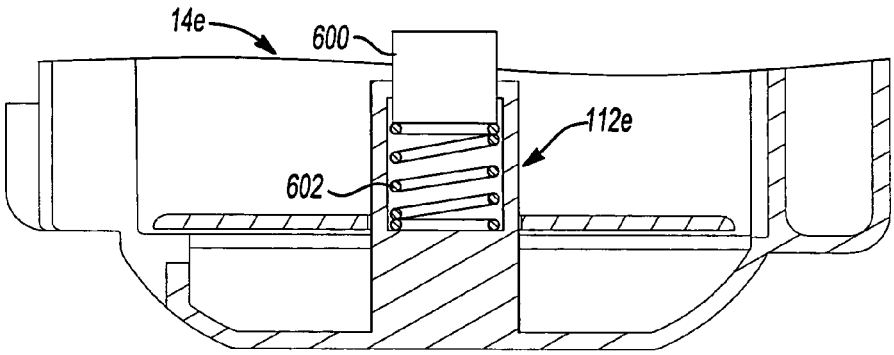
FIG. 21 is a partial side elevation view of a sixth magazine assembly constructed in accordance with the teachings of the present invention.
Figure 22:
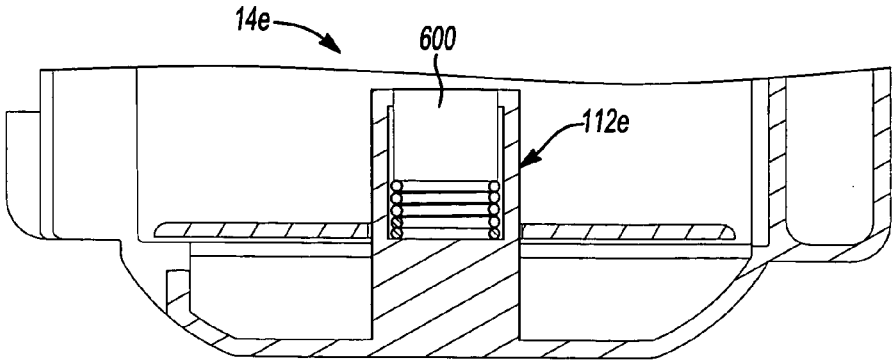
FIG. 22 is a side elevation view similar to that of FIG. 21 but illustrating a portion of the upper central hub of the nail platform in a retracted condition.

A sixth magazine assembly 14*e* constructed in accordance with the teachings of the present invention is illustrated in FIGS. 21 and 22. In this example, the central upper hub 112*e* includes a movable portion 600 which may telescope between a retracted position, which provides additional clearance for the loading of fasteners into the magazine assembly 14*e*, and an extended, in-use position. The movable portion 600 of the central upper hub 112*e* may be biased upwardly via a spring 602.

Figure 23:
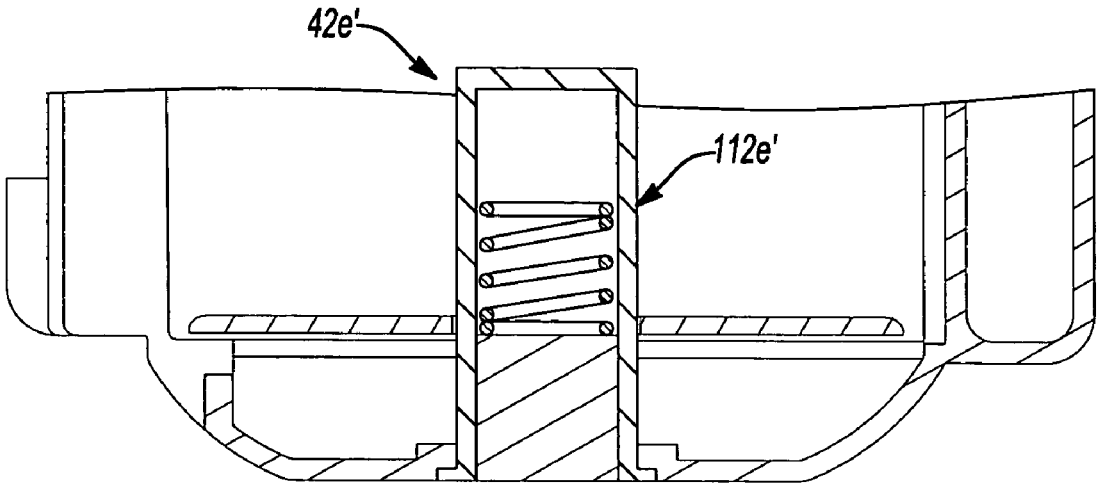
FIG. 23 is a side elevation view of an alternate embodiment of the magazine assembly of FIG. 21.
Figure 24:
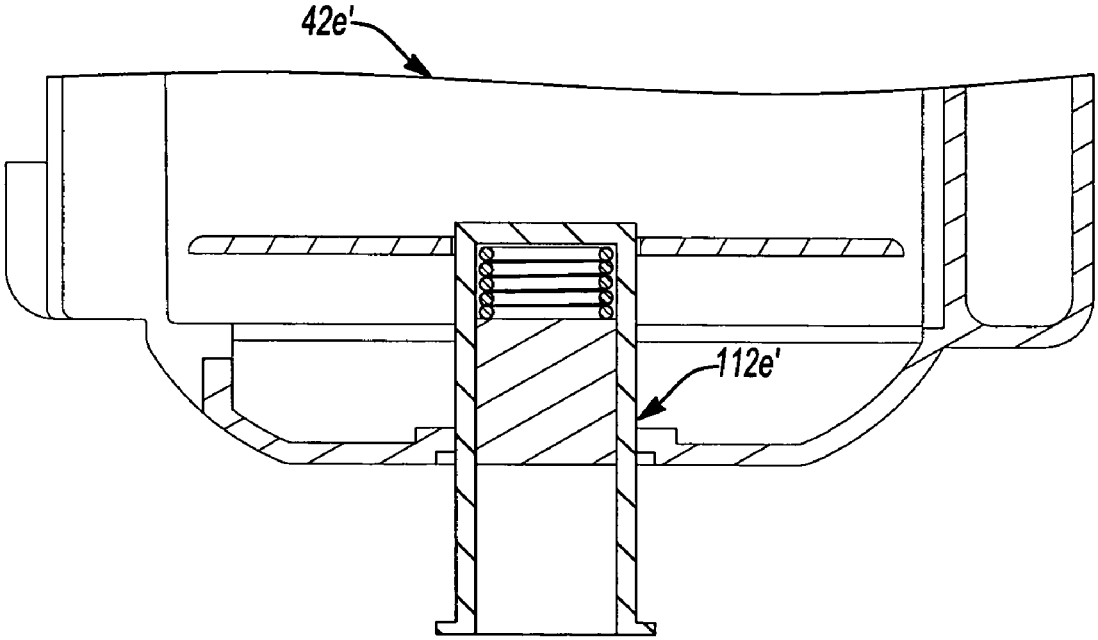
FIG. 24 is a side elevation view similar to that of FIG. 23 but illustrating the upper central hub of the nail platform in a retracted condition.

The embodiment of FIGS. 23 and 24 is generally similar to the embodiment of FIGS. 21 and 22, above, except that the entire central upper hub 112*e*' is movable between a retracted position, which provides additional clearance for the loading of fasteners into the magazine assembly 14*e*', and an extended, in-use position.

Figure 25:
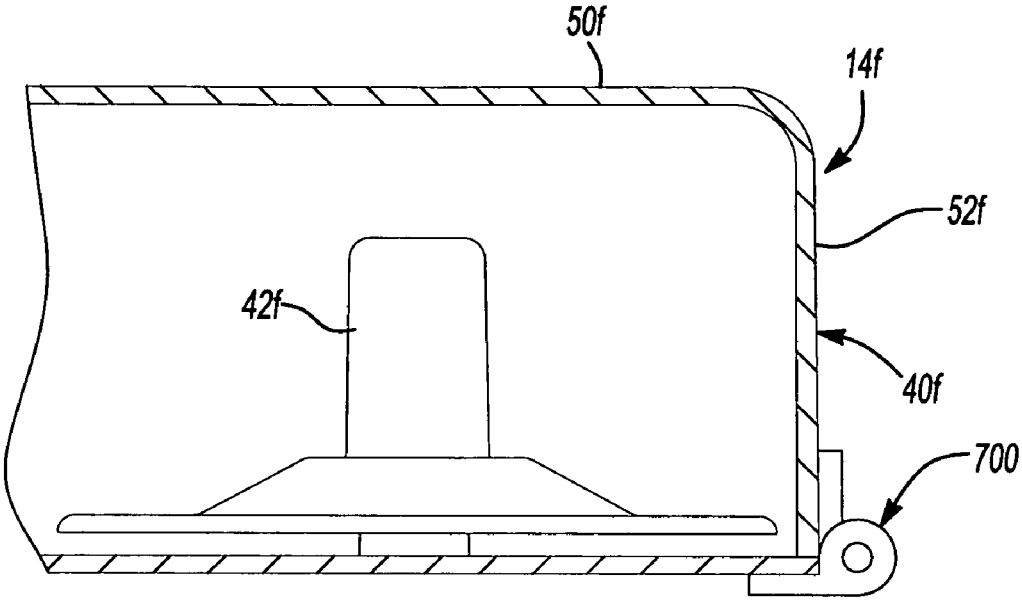
FIG. 25 is a schematic illustration of a seventh magazine assembly constructed in accordance with the teachings of the present invention.
Figure 26:
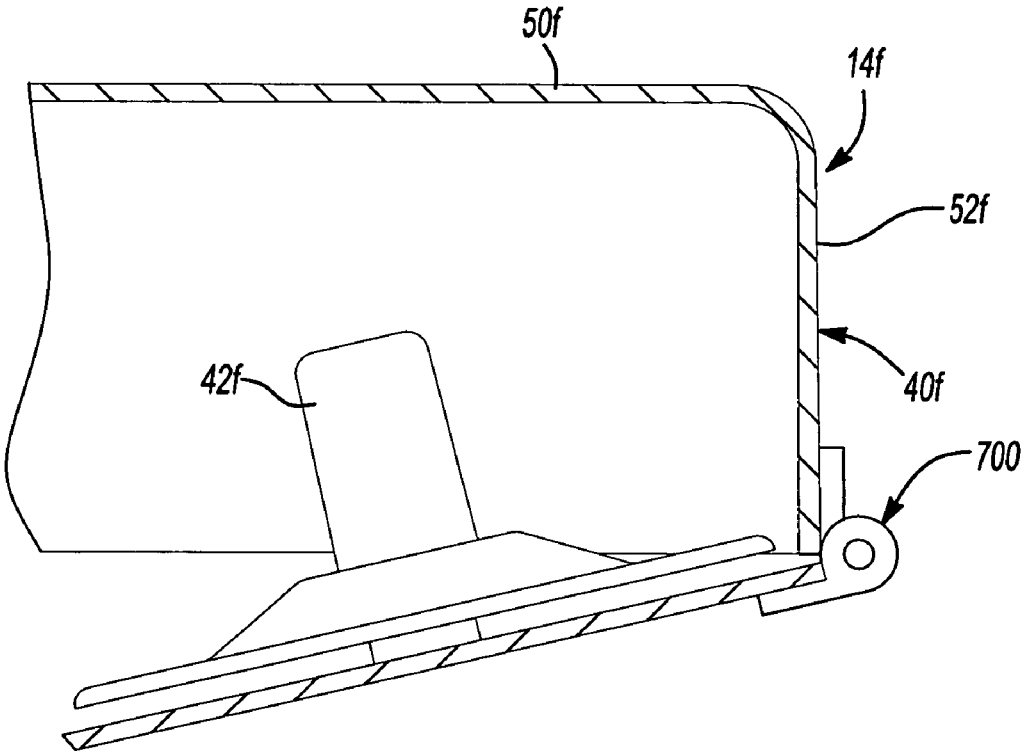
FIG. 26 is a schematic illustration similar to that of FIG. 25 but illustrating the magazine housing in an opened condition.

A seventh magazine assembly 14*f* constructed in accordance with the teachings of the present invention is illustrated in FIGS. 25 and 26. The magazine assembly 14*f* is generally similar to the magazine assembly 14 of FIGS. 1 through 8 except that the location of the hinge that couples the first and second housing portions 50*f* and 52*f* to one another is shifted and the first housing portion 50*f* does not include a sidewall. In the example illustrated, the hinge 700 is located at a bottom corner of the magazine housing 40*f*, which permits the magazine housing 40*f* to be opened in a manner that provides unrestricted access to the top of the nail plate 42*f*.

Figure 27:
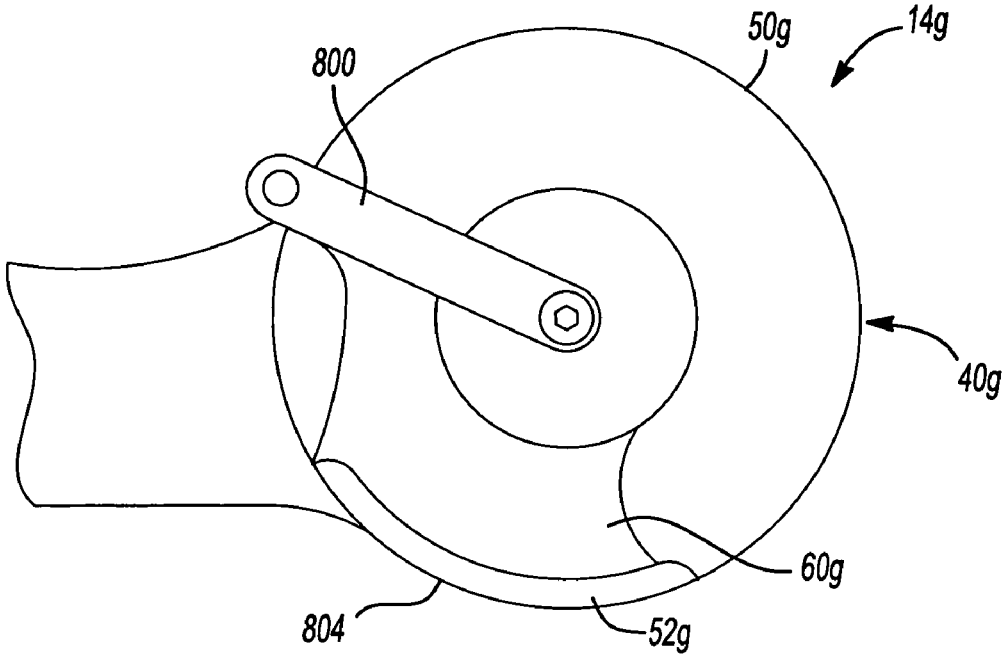
FIG. 27 is a schematic illustration of a eighth magazine assembly constructed in accordance with the teachings of the present invention.
Figure 28:
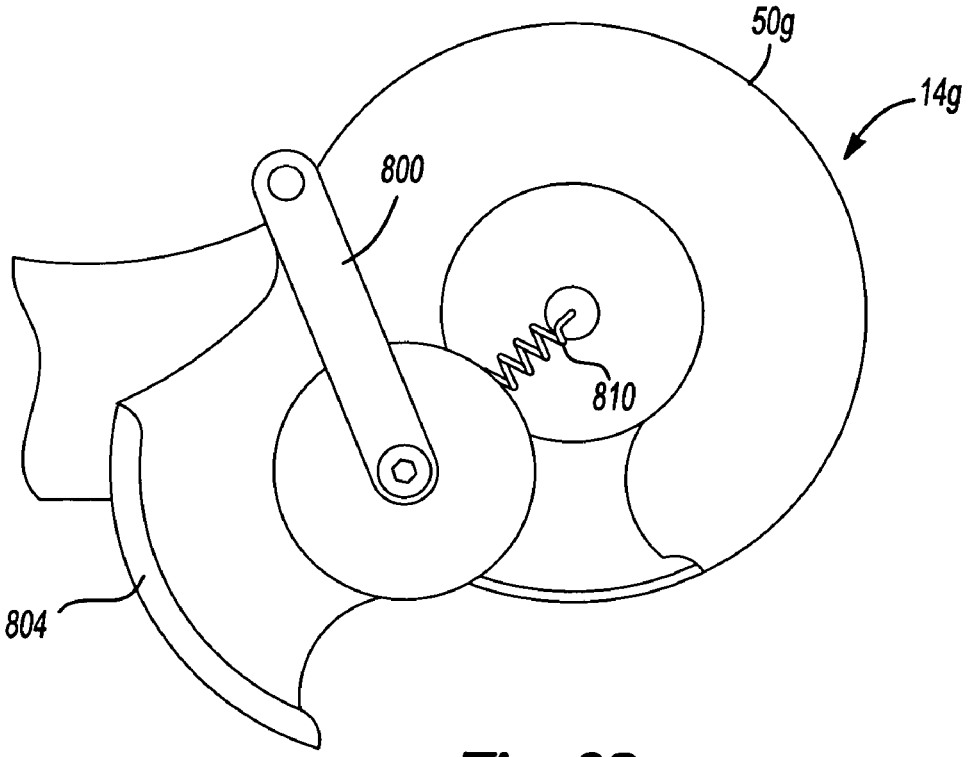
FIG. 28 is a schematic illustration similar to that of FIG. 27 but illustrating the magazine housing in an opened condition.

An eighth magazine assembly 14*g* constructed in accordance with the teachings of the present invention is illustrated in FIGS. 27 and 28. The magazine assembly 14*g* includes a magazine housing 40*g*, a nail plate 42*g*, and a swing arm 800. The magazine housing 40*g* includes a first housing portion 50*g*, which may be coupled to the housing assembly 12, and a second housing portion 52*g*, which may include a housing bottom 60*g* and a sidewall 804. The second housing portion 52*g* is mounted to the swing arm 800 and is movable between a first position, wherein the second housing portion 52*g* closes an opening in the side and bottom of the first housing portion 50*g*, and a second position, wherein the second housing portion 52*g* is pivoted outwardly and away from the first housing portion 50*g*. A spring 810 may be employed to bias the second housing portion 52*g* into the closed position.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise, above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A fastening tool comprising:

a tool housing; and a magazine assembly coupled to the tool housing, the magazine assembly including a magazine housing, a nail plate, a rotary cam and a spring, the magazine housing including a first portion and a second portion that is hingedly coupled to the first portion, the first portion including a central post, the nail plate being disposed over the central post and being axially but non-rotatably movable thereon, the rotary cam being disposed about the central post between the nail plate and a bottom member of the first portion of the magazine housing, the rotary cam including an adjustment lever that extends outwardly of the first portion of the magazine housing, the spring biasing the nail plate toward the rotary cam such that a plurality of feet that are coupled to the nail plate contact the rotary cam, wherein rotation of the rotary cam about the central post effects a change in a position of the nail plate relative to the central post.

2. A fastening tool comprising:

a tool housing; and a magazine assembly coupled to the tool housing, the magazine assembly including a magazine housing, a nail plate and a central post that is disposed through the nail plate, the magazine housing defining an interior cavity that is adapted to receive a plurality of collated fasteners, at least a portion of the central post being movably coupled to the magazine housing, the at least a portion of the central post being movable between an extended position, in which the central post extends from the nail plate into the interior cavity by a first distance, and a retracted postion in which the central post extends from the nail plate into the interior cavity by a second distance that is smaller than the first distance.

3. A fastening tool comprising:

a tool housing; and a magazine assembly coupled to the tool housing, the magazine assembly including a magazine housing and a nail plate, the magazine housing being non-movably coupled to the tool housing, the nail plate being pivotally connected to the magazine housing so as to swing away from the magazine housing when a plurality of fasteners are to be loaded against the nail plate.

4. The fastening tool of claim 3, wherein the nail plate is pivotally mounted to the magazine housing at a lower corner of the magazine housing.

5. The fastening tool of claim 3, wherein the nail plate is mounted on an arm that pivots relative to the magazine housing.

6. The fastening tool of claim 5, wherein a spring biases the nail plate into the magazine housing.

7. A fastening tool comprising:

a magazine housing having an exterior surface, the magazine housing having a first portion and a second portion that is movable relative to the first portion between an open position, which permits access to at least a portion of an interior space defined by the magazine housing, and a closed position that inhibits access to the at least a portion of the interior space;

a nail plate in the magazine housing; and an actuator disposed between the nail plate and the magazine housing, the actuator extending outwardly from the nail plate beyond the exterior surface of the magazine housing so as to be movable by a user when the second portion of the magazine housing is in the closed position to cause the nail plate to move axially with respect to the magazine housing.

8. The fastening tool of claim 1, wherein one of the actuator and the nail plate includes a cam.

9. The fastening tool of claim 8, wherein the cam is rotatable within the magazine housing.

10. The fastening tool of claim 9, wherein the nail plate is non-rotatably coupled to the magazine housing.

11. The fastening tool of claim 9, wherein the magazine includes a central post that extends through the cam.

12. The fastening tool of claim 11, wherein at least one radially extending tab is coupled to the central post, the at least one tab being spaced apart from a floor of the magazine housing, the cam being disposed between the at least one tab and the floor.

13. The fastening tool of claim 12, wherein the cam includes a central aperture that is sized to receive the post, the central aperture being shaped to axially slide on the post and over the at least one tab when the cam is positioned in a predetermined position and wherein rotation of the cam out of the predetermined position permits the at least one tab to limit movement of the cam along the post in a first axial direction.

14. The fastening tool of claim 8, wherein the other one of the actuator and the nail plate includes a plurality of feet, at least a portion of the feet contacting the cam to set a distance between a top of the magazine housing and the nail plate.

15. The fastening tool of claim 14, wherein the feet are similarly sized.

16. The fastening tool of claim 8, further comprising a spring for biasing the nail plate toward the actuator.

17. A fastening tool comprising:

a magazine housing that defines an interior chamber that is adapted to hold collated fasteners therein, the magazine housing including a first portion and a second portion that is movable relative to the first portion between an open position, which clears at least a portion of the first portion to permit access to the first portion of the magazine housing, and a closed position, at least one of the first and second portions defining a housing top;

a nail plate disposed in the magazine housing; and a nail plate adjuster for axially adjusting a position of the nail plate relative to the housing top, the nail plate adjuster being user-adjustable from the exterior of the magazine housing when the second portion of the magazine housing is in the closed position.

18. The fastening tool of claim 17, wherein the nail plate adjuster includes a first set of teeth and a second set of teeth and wherein adjustment of the nail plate relative to the housing top is effected by relative rotation of one of the first and second sets of teeth relative to the other one of the first and second sets of teeth.

19. The fastening tool of claim 18, wherein one of the first and second sets of teeth are disposed about a first pitch circle that is perpendicular to an axis along which the nail plate translates and wherein the other one of the first and second sets of teeth are partially disposed about a second pitch circle that is tilted relative to the first pitch circle.

20. The fastening tool of Claim 18, wherein the first set of teeth are coupled to the nail plate.

21. The fastening tool of claim 20, wherein the second set of teeth are coupled to a structure that closes a bottom end of the magazine housing.

22. The fastening tool of claim 21, further comprising a latch that is movable between a first position, which permits the second set of teeth to be moved axially away from the first set of teeth, and a second position which maintains the first set of teeth in meshing engagement with the second set of teeth.

23. The fastening tool of claim 17, wherein the nail plate adjuster includes a cam that is rotatable within the magazine housing.

24. The fastening tool of claim 23, wherein the nail plate is non-rotatable relative to the magazine housing.

25. The fastening tool of claim 24, wherein the nail plate adjuster further comprise a plurality of feet that extend from the nail plate and contact the cam.

* * * * *

UNITED STATES PATENT AND TRADEMARK OFFICE

CERTIFICATE OF CORRECTION

PATENT NO. : 8,172,118 B2
APPLICATION NO. : 10/852990
DATED : May 8, 2012
INVENTOR(S) : James R. Niblett et al.

It is certified that error appears in the above-identified patent and that said Letters Patent is hereby corrected as shown below:

Column 9,
Line 6 (Claim 8), "claim 1" should be -- claim 7 --.

Column 10,
Line 37 (Claim 25), "comprise" should be -- comprises --.

Signed and Sealed this
Twenty-first Day of August, 2012

David J. Kappos

David J. Kappos
*Director of the United States Patent and Trademark Office*